US009289014B2

(12) United States Patent
Tucker et al.

(10) Patent No.: US 9,289,014 B2
(45) Date of Patent: Mar. 22, 2016

(54) ELECTRONIC SMOKING ARTICLE AND IMPROVED HEATER ELEMENT

(71) Applicant: Altria Client Services Inc., Richmond, VA (US)

(72) Inventors: Christopher S. Tucker, Midlothian, VA (US); Geoffrey B. Jordan, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 447 days.

(21) Appl. No.: 13/774,609

(22) Filed: Feb. 22, 2013

(65) Prior Publication Data

US 2013/0213419 A1 Aug. 22, 2013

Related U.S. Application Data

(60) Provisional application No. 61/601,889, filed on Feb. 22, 2012.

(51) Int. Cl.
*A24F 47/00* (2006.01)

(52) U.S. Cl.
CPC ..... *A24F 47/008* (2013.01)

(58) Field of Classification Search
CPC ..... A24F 27/008; A61M 15/00; A61M 15/06; A61M 11/042; A61L 9/037; A61L 9/14; A61L 2209/135
USPC ..... 239/13, 44, 136
See application file for complete search history.

(56) References Cited

U.S. PATENT DOCUMENTS

| | | | |
|---|---|---|---|
| 1,771,366 | A | 7/1930 | Wyss et al. |
| 1,968,509 | A | 7/1934 | Tiffany |
| 2,057,353 | A | 10/1936 | Whittemore, Jr. |
| 2,104,266 | A | 1/1938 | McCormick |
| 2,406,275 | A | 8/1946 | Wejnarth |
| 2,442,004 | A | 5/1948 | Hayward-Butt |
| 2,558,127 | A | 6/1951 | Downs |
| 2,907,686 | A | 10/1959 | Siegel |
| 2,971,039 | A | 2/1961 | Western |
| 2,972,557 | A | 2/1961 | Toulmin, Jr. |
| 2,974,669 | A | 3/1961 | Ellis |
| 3,062,218 | A | 11/1962 | Temkovits |

(Continued)

FOREIGN PATENT DOCUMENTS

| | | |
|---|---|---|
| BE | 421623 | 6/1937 |
| CA | 1202378 | 3/1986 |

(Continued)

OTHER PUBLICATIONS

ECF 'Modding Forum' ("All my mods part1" Discussion in Modding forum started by Raidy, Oct. 26, 2010 on www.e-cigarette-forum.com)—Accessed Jun. 26, 2015.*

(Continued)

*Primary Examiner* — Jason L Lazorcik
(74) *Attorney, Agent, or Firm* — Harness, Dickey & Pierce

(57) ABSTRACT

An electronic cigarette includes a liquid supply including liquid material, a heater operable to heat the liquid material to a temperature sufficient to vaporize the liquid material and form an aerosol, and a wick in communication with the liquid material and in communication with the heater such that the wick delivers the liquid material to the heater. The heater is formed of a mesh material.

18 Claims, 4 Drawing Sheets

(56) References Cited

U.S. PATENT DOCUMENTS 3,200,819 A 8/1965 Gilbert
3,255,760 A 6/1966 Selker
3,258,015 A 6/1966 Ellis et al.
3,356,094 A 12/1967 Ellis et al.
3,363,633 A 1/1968 Weber
3,402,723 A 9/1968 Hu
3,482,580 A 12/1969 Hollabaugh
3,521,643 A 7/1970 Toth
3,559,300 A 2/1971 Fox
3,608,560 A 9/1971 Briskin et al.
3,681,018 A 8/1972 Karl-Georg Knauff
3,738,374 A 6/1973 Bennett
3,744,496 A 7/1973 McCarty et al.
3,804,100 A 4/1974 Fariello
3,875,476 A 4/1975 Crandall et al.
3,878,041 A 4/1975 Leitnaker et al.
3,889,690 A 6/1975 Guarnieri
3,895,219 A 7/1975 Richerson et al.
3,943,941 A 3/1976 Boyd et al.
4,016,061 A 4/1977 Wasa et al.
4,068,672 A 1/1978 Guerra
4,077,784 A 3/1978 Vayrynen
4,083,372 A 4/1978 Boden
4,098,725 A 7/1978 Yamamoto et al.
4,110,260 A 8/1978 Yamamoto et al.
4,131,119 A 12/1978 Blasutti
4,141,369 A 2/1979 Burruss
4,164,230 A 8/1979 Pearlman
4,193,411 A 3/1980 Faris et al.
4,215,708 A 8/1980 Bron
4,219,032 A 8/1980 Tabatznik et al.
4,246,913 A 1/1981 Ogden et al.
4,256,945 A * 3/1981 Carter ..... H05B 3/42 219/229
4,259,970 A 4/1981 Green, Jr.
4,331,166 A 5/1982 Hale
4,419,302 A 12/1983 Nishino et al.
4,457,319 A 7/1984 Lamb et al.
4,493,331 A 1/1985 Porenski, Jr.
4,517,996 A 5/1985 Vester
4,649,944 A 3/1987 Houck, Jr. et al.
4,687,008 A 8/1987 Houck, Jr. et al.
4,735,217 A 4/1988 Gerth et al.
4,765,347 A 8/1988 Sensabaugh et al.
4,804,002 A 2/1989 Herron
4,941,486 A 7/1990 Dube et al.
4,945,929 A 8/1990 Egilmex
4,945,931 A 8/1990 Gori
4,981,522 A 1/1991 Nichols et al.
4,991,606 A 2/1991 Serrano et al.
4,993,436 A 2/1991 Bloom, Jr.
5,016,656 A 5/1991 McMurtrie
5,040,552 A 8/1991 Schleich et al.
5,042,510 A 8/1991 Curtiss et al.
5,045,237 A 9/1991 Washburn
5,060,671 A 10/1991 Counts et al.
5,076,296 A 12/1991 Nystrom et al.
5,085,804 A 2/1992 Washburn
5,093,894 A 3/1992 Deevi et al.
5,095,921 A 3/1992 Losee et al.
5,116,298 A 5/1992 Bondanelli et al.
5,137,578 A 8/1992 Chan
5,139,594 A 8/1992 Rabin
5,144,962 A 9/1992 Counts et al.
5,144,964 A 9/1992 Demain
5,157,242 A 10/1992 Hetherington et al.
5,159,940 A 11/1992 Hayward et al.
5,179,966 A 1/1993 Losee et al.
5,224,498 A 7/1993 Deevi et al.
5,228,460 A 7/1993 Sprinkel et al.
5,235,157 A 8/1993 Blackburn
5,249,586 A 10/1993 Morgan et al.
5,269,327 A 12/1993 Counts et al.
5,274,214 A 12/1993 Blackburn
5,285,050 A 2/1994 Blackburn
5,322,075 A 6/1994 Deevi et al.
5,353,813 A 10/1994 Deevi et al.
5,369,723 A 11/1994 Counts et al.
5,388,594 A 2/1995 Counts et al.
5,396,911 A 3/1995 Casey, III et al.
5,408,574 A 4/1995 Deevi et al.
5,498,855 A 3/1996 Deevi et al.
5,505,214 A 4/1996 Collins et al.
5,591,368 A 1/1997 Fleischhauer et al.
5,595,706 A 1/1997 Sikka et al.
5,613,504 A 3/1997 Collins et al.
5,665,262 A 9/1997 Hajaligol et al.
5,724,997 A 3/1998 Smith et al.
5,743,251 A 4/1998 Howell et al.
5,865,185 A 2/1999 Collins et al.
5,878,752 A 3/1999 Adams et al.
5,894,841 A 4/1999 Voges
5,935,975 A 8/1999 Rose et al.
6,155,268 A 12/2000 Takeuchi
6,196,218 B1 3/2001 Voges
6,598,607 B2 7/2003 Adiga et al.
6,715,487 B2 4/2004 Nichols et al.
6,772,756 B2 8/2004 Shayan
6,810,883 B2 11/2004 Felter et al.
6,854,470 B1 2/2005 Pu
7,131,599 B2 11/2006 Katase
7,167,641 B2 1/2007 Tam et al.
7,458,374 B2 12/2008 Hale et al.
D590,988 S 4/2009 Hon
D590,989 S 4/2009 Hon
D590,990 S 4/2009 Hon
D590,991 S 4/2009 Hon
7,527,059 B2 5/2009 Iannuzzi
7,614,402 B2 11/2009 Gomes
7,726,320 B2 6/2010 Robinson et al.
7,789,089 B2 9/2010 Dube et al.
7,810,508 B2 10/2010 Wyss-Peters et al.
7,832,410 B2 11/2010 Hon
7,845,359 B2 12/2010 Montaser
7,878,962 B2 2/2011 Karles et al.
7,913,688 B2 3/2011 Cross et al.
7,920,777 B2 4/2011 Rabin et al.
7,938,124 B2 5/2011 Izumiya et al.
7,997,280 B2 8/2011 Rosenthal
8,079,371 B2 12/2011 Robinson et al.
D655,036 S 2/2012 Zhou
8,113,215 B2 2/2012 Rasouli et al.
8,118,161 B2 2/2012 Guerrera et al.
8,127,772 B2 3/2012 Montaser
8,156,944 B2 4/2012 Han
8,157,918 B2 4/2012 Becker et al.
8,205,622 B2 6/2012 Pan
8,258,192 B2 9/2012 Wu et al.
8,314,591 B2 11/2012 Terry et al.
8,365,742 B2 2/2013 Han
8,371,310 B2 2/2013 Brenneise
8,375,957 B2 2/2013 Hon
D684,311 S 6/2013 Liu
8,459,270 B2 6/2013 Coven et al.
8,499,766 B1 8/2013 Newton
8,550,069 B2 10/2013 Alelov
2002/0112723 A1* 8/2002 Schuster ..... A61M 15/00 128/203.26
2004/0020500 A1 2/2004 Wrenn et al.
2004/0035409 A1* 2/2004 Harwig ..... A01M 1/2072 126/96
2004/0050396 A1 3/2004 Squeo
2005/0016550 A1 1/2005 Katase
2006/0191546 A1 8/2006 Takano et al.
2006/0196518 A1 9/2006 Hon
2007/0102013 A1 5/2007 Adams et al.
2007/0267032 A1 11/2007 Shan
2008/0047571 A1 2/2008 Braunshteyn et al.
2008/0230052 A1 9/2008 Montaser
2009/0056729 A1 3/2009 Zawadzki et al.
2009/0126745 A1 5/2009 Hon
2009/0133704 A1 5/2009 Strickland et al.
2009/0151717 A1 6/2009 Bowen et al.
2009/0162294 A1 6/2009 Werner

(56) References Cited

U.S. PATENT DOCUMENTS

| | | | | |
|---|---|---|---|---|
| 2009/0188490 | A1 | 7/2009 | Han | |
| 2009/0230117 | A1 | 9/2009 | Fernando et al. | |
| 2009/0272379 | A1 | 11/2009 | Thorens et al. | |
| 2009/0283103 | A1 | 11/2009 | Nielsen et al. | |
| 2010/0031968 | A1 | 2/2010 | Sheikh et al. | |
| 2010/0083959 | A1 | 4/2010 | Siller | |
| 2010/0126505 | A1 | 5/2010 | Rinker | |
| 2010/0200008 | A1 | 8/2010 | Taieb | |
| 2010/0206317 | A1 | 8/2010 | Albino et al. | |
| 2010/0242975 | A1 | 9/2010 | Hearn | |
| 2010/0242976 | A1 | 9/2010 | Katayama et al. | |
| 2010/0307518 | A1 | 12/2010 | Wang | |
| 2011/0005535 | A1 | 1/2011 | Xiu | |
| 2011/0011396 | A1 | 1/2011 | Fang | |
| 2011/0036346 | A1 | 2/2011 | Cohen et al. | |
| 2011/0036363 | A1 | 2/2011 | Urtsev et al. | |
| 2011/0094523 | A1 | 4/2011 | Thorens et al. | |
| 2011/0120455 | A1 | 5/2011 | Murphy | |
| 2011/0120482 | A1 | 5/2011 | Brenneise | |
| 2011/0147486 | A1 | 6/2011 | Greim et al. | |
| 2011/0155153 | A1 | 6/2011 | Thorens et al. | |
| 2011/0232654 | A1 | 9/2011 | Mass | |
| 2011/0245493 | A1 | 10/2011 | Rabinowitz et al. | |
| 2011/0253798 | A1* | 10/2011 | Tucker | A61L 9/037 239/13 |
| 2011/0265806 | A1 | 11/2011 | Alarcon et al. | |
| 2011/0277756 | A1 | 11/2011 | Terry et al. | |
| 2011/0277757 | A1 | 11/2011 | Terry et al. | |
| 2011/0277760 | A1 | 11/2011 | Terry et al. | |
| 2011/0277761 | A1 | 11/2011 | Terry et al. | |
| 2011/0277764 | A1 | 11/2011 | Terry et al. | |
| 2011/0277780 | A1 | 11/2011 | Terry et al. | |
| 2011/0290244 | A1 | 12/2011 | Schennum | |
| 2011/0303231 | A1 | 12/2011 | Li et al. | |
| 2011/0304282 | A1 | 12/2011 | Li et al. | |
| 2011/0309157 | A1* | 12/2011 | Yang | A01M 1/2077 239/6 |
| 2012/0006342 | A1 | 1/2012 | Rose et al. | |
| 2012/0090629 | A1 | 4/2012 | Turner et al. | |
| 2012/0111347 | A1 | 5/2012 | Hon | |
| 2012/0118301 | A1 | 5/2012 | Montaser | |
| 2012/0145169 | A1 | 6/2012 | Wu | |
| 2012/0167906 | A1 | 7/2012 | Gysland | |
| 2012/0174914 | A1 | 7/2012 | Pirshafiey et al. | |
| 2012/0186594 | A1 | 7/2012 | Liu | |
| 2012/0199146 | A1 | 8/2012 | Marangos | |
| 2012/0199663 | A1 | 8/2012 | Qiu | |
| 2012/0211015 | A1 | 8/2012 | Li et al. | |
| 2012/0230659 | A1 | 9/2012 | Goodman et al. | |
| 2012/0260927 | A1 | 10/2012 | Liu | |
| 2012/0285475 | A1 | 11/2012 | Liu | |
| 2012/0312313 | A1 | 12/2012 | Frija | |
| 2012/0318882 | A1 | 12/2012 | Abehasera | |
| 2013/0014772 | A1 | 1/2013 | Liu | |
| 2013/0019887 | A1 | 1/2013 | Liu | |
| 2013/0025609 | A1 | 1/2013 | Liu | |
| 2013/0192615 | A1 | 8/2013 | Tucker et al. | |
| 2013/0192616 | A1 | 8/2013 | Tucker et al. | |
| 2013/0192619 | A1 | 8/2013 | Tucker et al. | |
| 2013/0192620 | A1 | 8/2013 | Tucker et al. | |
| 2013/0192621 | A1 | 8/2013 | Li et al. | |
| 2013/0192622 | A1 | 8/2013 | Tucker et al. | |
| 2013/0192623 | A1 | 8/2013 | Tucker et al. | |
| 2013/0213418 | A1 | 8/2013 | Tucker et al. | |
| 2014/0109905 | A1* | 4/2014 | Yamada | A61M 15/06 128/203.27 |
| 2014/0238423 | A1* | 8/2014 | Tucker | A24F 47/008 131/328 |
| 2015/0090280 | A1* | 4/2015 | Chen | A24F 47/008 131/329 |
| 2015/0101606 | A1* | 4/2015 | White | A24F 47/008 128/203.26 |

FOREIGN PATENT DOCUMENTS

| | | | |
|---|---|---|---|
| CN | 87104459 | A | 2/1988 |
| CN | 2777995 | Y | 5/2006 |
| CN | 101322579 | A | 12/2008 |
| CN | 201709398 | U | 1/2011 |
| CN | 201789924 | U | 4/2011 |
| CN | 201797997 | U | 4/2011 |
| CN | 102106611 | A | 6/2011 |
| CN | 201860753 | U | 6/2011 |
| CN | 102166044 | A | 8/2011 |
| CN | 202014571 | U | 10/2011 |
| CN | 202014572 | U | 10/2011 |
| CN | 202026804 | U | 11/2011 |
| CN | 202233005 | U | 5/2012 |
| CN | 202233007 | U | 5/2012 |
| DE | 3640917 | | 8/1988 |
| DE | 3735704 | | 5/1989 |
| DE | 19854009 | | 5/2000 |
| DE | 69824982 | | 10/2004 |
| EP | 0277519 | | 8/1988 |
| EP | 0295122 | | 12/1988 |
| EP | 0358 002 | | 3/1990 |
| EP | 0358114 | | 3/1990 |
| EP | 0488488 | | 6/1992 |
| EP | 0503767 | | 9/1992 |
| EP | 0845220 | | 6/1998 |
| EP | 0857431 | | 8/1998 |
| EP | 0893071 | | 1/1999 |
| EP | 1989946 | | 11/2008 |
| EP | 2110033 | | 10/2009 |
| EP | 2113178 | A1 | 11/2009 |
| GB | 2148079 | | 5/1985 |
| JP | 61068061 | | 4/1986 |
| JP | 2006320286 | | 11/2006 |
| KR | 100636287 | | 10/2006 |
| NL | 8201585 | | 11/1982 |
| WO | WO86/02528 | | 5/1986 |
| WO | WO9003224 | | 4/1990 |
| WO | WO95/02970 | | 2/1995 |
| WO | WO00/28843 | | 3/2000 |
| WO | WO-03/034847 | A1 | 5/2003 |
| WO | WO03037412 | | 5/2003 |
| WO | WO2004/080216 | | 9/2004 |
| WO | WO2004/095955 | | 11/2004 |
| WO | WO2005/099494 | | 10/2005 |
| WO | WO2005120614 | | 12/2005 |
| WO | WO2007024130 | | 3/2007 |
| WO | WO2007/066374 | | 6/2007 |
| WO | WO2007/078273 | | 7/2007 |
| WO | WO2007/098337 | | 8/2007 |
| WO | WO2007/131449 | | 11/2007 |
| WO | WO2007/131450 | | 11/2007 |
| WO | WO2007/141668 | | 12/2007 |
| WO | WO2008/055423 | | 5/2008 |
| WO | WO2010/091593 | | 8/2010 |
| WO | WO2010/145468 | | 12/2010 |
| WO | WO-2011/045672 | A1 | 4/2011 |
| WO | WO2011/121326 | | 10/2011 |
| WO | WO2011/124033 | | 10/2011 |
| WO | WO2011/125058 | | 10/2011 |
| WO | WO2011/146372 | | 11/2011 |
| WO | WO2012/088675 | | 7/2012 |
| WO | WO2012/109371 | | 8/2012 |
| WO | WO2012/129787 | | 10/2012 |
| WO | WO2012/129812 | | 10/2012 |
| WO | WO2012/142293 | | 10/2012 |

OTHER PUBLICATIONS

International Preliminary Report dated Nov. 27, 2014.

International Search Report and Written Opinion for PCT/US13/24228 dated Apr. 9, 2013.

International Search Report and Written Opinion for PCT/US13/24211 dated Apr. 19, 2013.

International Search Report and Written Opinion for PCT/US13/24219 dated Apr. 22, 2013.

International Search Report and Written Opinion for PCT/US13/24229 dated Apr. 22, 2013.

(56) References Cited

OTHER PUBLICATIONS

International Search Report and Written Opinion for PCT/US13/24215 dated Apr. 22, 2013.
International Search Report and Written Opinion for PCT/US13/24222 dated Apr. 24, 2013.
International Search Report and Written Opinion for PCT/US13/27424 dated Apr. 25, 2013.
International Search Report and Written Opinion for PCT/US13/27432 dated May 2, 2013.
International Search Report and Written Opinion for PCT/US13/24224 dated May 13, 2013.
U.S. Appl. No. 13/843,028, filed Mar. 15, 2013, to Fath et al.
U.S. Appl. No. 13/843,314, filed Mar. 15, 2013, to Fath et al.
U.S. Appl. No. 13/843,449, filed Mar. 15, 2013, to Fath et al.
European Search Report mailed on Dec. 11, 2015.

* cited by examiner

ELECTRONIC SMOKING ARTICLE AND IMPROVED HEATER ELEMENT

CROSS REFERENCE TO RELATED APPLICATION

This application claims priority under 35 U.S.C. §119(e) to U.S. Provisional Application No. 61/601,889, filed on Feb. 22, 2012, the entire content of which is incorporated herein by reference thereto.

SUMMARY OF SELECTED FEATURES

An electronic cigarette includes a heater comprising a ribbon of electrically resistive mesh material wound about a wick. The wick is in communication with a liquid supply containing liquid material. The heater is operative to vaporize liquid material to produce an aerosol.

DETAILED DESCRIPTION

An electronic cigarette (smoking article) includes a mesh heater element and in a preferred embodiment, a heater formed of a ribbon of electrically resistive mesh material wrapped around a wick that is in fluid communication with a liquid supply. The use of a planar metal ribbon such as a mesh material as the heater provides many advantages. The wrapped ribbon provides increased surface to surface contact between the heater and the wick so as to provide more efficient and uniform transfer of heat between the heater and the wick. The arrangement provides a greater volume of aerosol for the same amount of electrical energy, than a wire heater (a single wire coil). In addition, dimensions of the ribbon heater may be adjusted to achieve a higher or lower electrical resistivity to meet design requirements of a particular electronic cigarette. Being a ribbon of material, the resistivity of the ribbon heater can be more consistently controlled from one heater to the next. Likewise, because of the size of the ribbon heater, the wrapping of the ribbon heater about the wick may be more consistently controlled.

Preferably, the ribbon heater is wrapped uniformly about the wick so that there is uniform spacing between windings of the ribbon heater about the wick. The size and surface to surface contact between the ribbon heater and the wick ensures retention of the uniform spacing which in turn ensures uniform heating of the wick.

Figure 1:
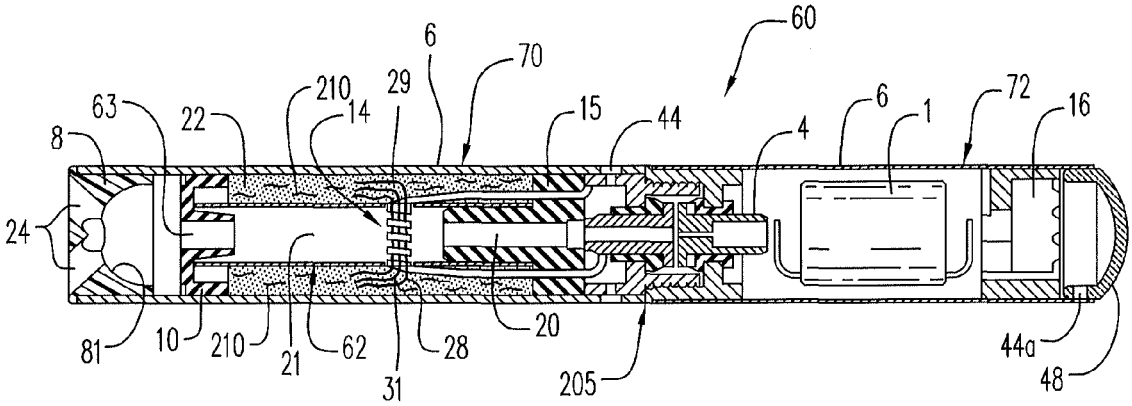
FIG. 1 is a cross-sectional view of an electronic cigarette according to a first embodiment wherein the mouth-end insert includes diverging outlets.
Figure 4:
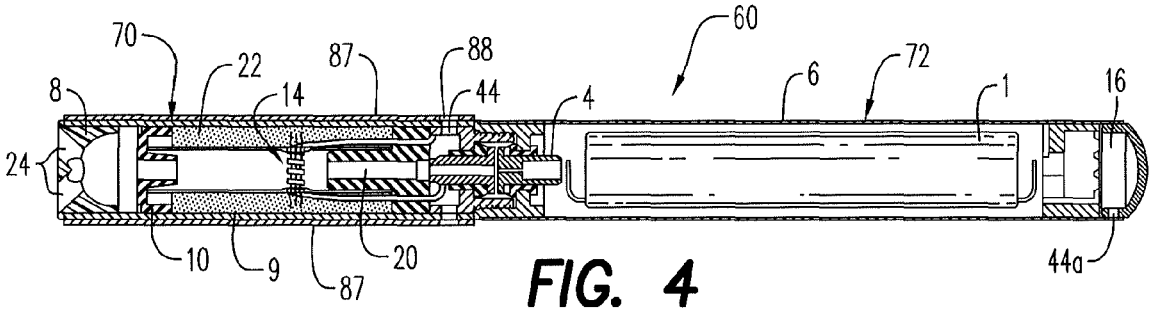
FIG. 4 is a cross-sectional view of an electronic cigarette according to the first embodiment and further including a sleeve assembly.

As shown in FIGS. 1 and 4, an electronic cigarette 60 comprises a replaceable cartridge (or first section) 70 and a reusable fixture (or second section) 72, which are coupled together at a threaded connection 205 or by other convenience such as a snug-fit, detent, snap-fit, clamp and/or clasp. The first section 70 includes an outer tube 6 (or casing) extending in a longitudinal direction and an inner tube 62 coaxially positioned within the outer tube 6. The electronic cigarette 60 also includes a central air passage 20 in an upstream seal 15. The central air passage 20 opens to the inner tube 62. Moreover, the electronic cigarette 60 includes a liquid supply 22. The liquid supply 22 comprises a liquid material and optionally a liquid storage medium 210 (shown in FIG. 1) operable to store the liquid material therein. Preferably, the liquid supply 22 is contained in an outer annulus between the outer tube 6 and the inner tube 62. The annulus is sealed at an upstream end by seal 15 and liquid stopper 10 at a downstream end so as to prevent leakage of the liquid material from the liquid supply 22. Thus, the liquid supply 22 at least partially surrounds the central air passage 20. In other embodiments, the liquid supply 22 could be a self-contained bottle or other vessel capable of containing liquid. A heater 14 extends transversely across the central channel 21.

In the preferred embodiment, the heater 14 is also contained in the inner tube 62 downstream of and in spaced apart relation to the central air passage 20. A wick 28 is in communication with the liquid material in the liquid supply 22 and in communication with the heater 14 such that the wick 28 disposes liquid material in proximate relation to the heater 14. The wick 28 preferably comprises filaments having a capacity to draw a liquid, more preferably a bundle of glass (or ceramic) filaments and most preferably a bundle comprising a group of windings of glass filaments, preferably three of such windings, all which arrangements are capable of drawing liquid via capillary action via interstitial spacings between the filaments. Preferably, the wick 28 is flexible and includes three strands, each strand including a plurality of filaments. Moreover, it is noted that the end portions 29 and 31 of the wick 28 are flexible and foldable into the confines of the liquid supply region 22. The wick 28 can include filaments having a cross-section which is generally cross-shaped, clover-shaped, Y-shaped or in any other suitable shape.

Preferably, the wick 28 includes any suitable material or combination of materials. Examples of suitable materials are ceramic- or graphite-based materials. Moreover, the wick 28 may have any suitable capillarity and porosity to accommodate aerosol generating liquids having different liquid physical properties such as density, viscosity, surface tension and vapor pressure. The capillary properties of the wick 28, combined with the properties of the liquid, ensure that the wick 28 is always wet in the area of the heater 14 to avoid overheating of the heater 14.

A power supply 1 in the fixture 72 is operable to apply voltage across the heater 14. The electronic cigarette 60 also includes at least one air inlet 44 operable to deliver air to the central air passage 20 and/or other portions of the inner tube 62.

The electronic cigarette 60 further includes a mouth-end insert 8 having at least two off-axis, preferably diverging outlets 24 (e.g., 3, 4, 5 or more, preferably 2 to 10 outlets or more, more preferably 6 to 8 outlets, even more preferably 2 to 6 outlets or 4 outlets). The mouth-end insert 8 is in fluid communication with the central air passage 20 via the interior of inner tube 62 and a central passage 63, which extends through the stopper 10.

Moreover, as shown in FIGS. 1, 4, 10 and 11, the heater 14 extends in a direction transverse to the longitudinal direction and heats the liquid material to a temperature sufficient to vaporize the liquid material and form an aerosol. In other embodiments, other orientations of the heater 14 are contemplated, such as shown in FIG. 12, the heater 14 is arranged longitudinally within the inner tube 62. By arranging the heater 14 longitudinally, the surface of the heater 14 is within the inner tube and delivers a larger volume of aerosol than heaters extending transverse to the longitudinal direction and into the outer annulus. Also preferably, as shown, the heater 14 is arranged centrally within the inner tube 62. However, in other embodiments the heater 14 can be arranged adjacent an inner surface of the inner tube 62.

Referring now to FIG. 1, the wick 28, liquid supply 22 and mouth-end insert 8 are contained in the first section 70 and the power supply 1 is contained in a second section 72. In one embodiment, the first section (the cartridge) 70 is disposable and the second section (the fixture) 72 is reusable. The sections 70, 72 can be attached by a threaded connection 205 whereby the downstream section 70 can be replaced when the liquid supply 22 is used up. Having a separate first section 70 and second section 72 provides a number of advantages. First, if the first section 70 contains the at least one heater 14, the liquid supply 22 and the wick 28, all elements which are potentially in contact with the liquid are disposed of when the first section 70 is replaced. Thus, there will be no cross-contamination between different first sections 70, for example, when using different liquid materials. Also, if the first section 70 is replaced at suitable intervals, there is little chance of the heater becoming clogged with liquid. Moreover, the amount of liquid in the liquid supply 22 can be chosen such that the liquid supply 22 is depleted once a full battery charge is also depleted. Thus, the first section 70 could be replaced with every battery charge. Optionally, the first section 70 and the second section 72 are arranged to releasably lock together when engaged.

Figure 5:
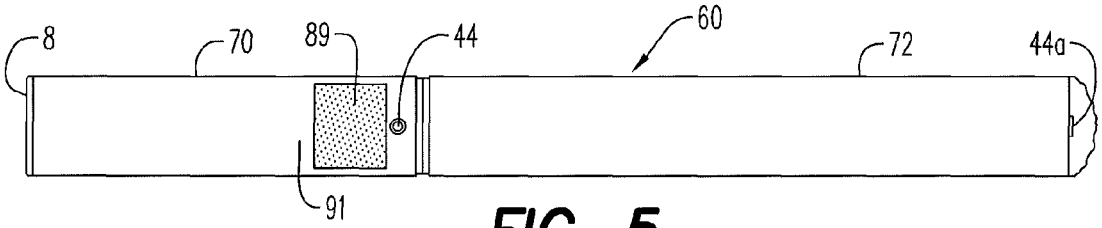
FIG. 5 is a top view of an electronic cigarette including an aroma strip on an outer surface thereof.

In the preferred embodiment, the at least one air inlet 44 includes one or two air inlets. Alternatively, there may be three, four, five or more air inlets. Preferably, if there is more than one air inlet, the air inlets are located at different locations along the electronic cigarette 60. For example, as shown in FIGS. 4 and 5, an air inlet **44*a* can be positioned at the upstream end of the cigarette adjacent puff sensor 16 such that the puff sensor supplies power to the heater upon sensing a puff by the smoker. Air inlet 44*a* should communicate with the mouth-end insert 8 so that a draw upon the electronic cigarette activates the puff sensor. The air from air inlet 44*a* can then flow along the battery and to the central air passage 20 in the seal 15 and/or to other portions of the inner tube 62 and/or outer tube 6. At least one additional air inlet 44 can be located adjacent and upstream of the seal 15 or at any other desirable location. Altering the size and number of air inlets 44 can also aid in establishing the resistance to draw of the electronic cigarette 60**.

In a preferred embodiment, the heater 14 is arranged to communicate with the wick 28 and to heat the liquid material contained in the wick 28 to a temperature sufficient to vaporize the liquid material and form an aerosol.

Preferably, the heater 14 is preferably a ribbon of wire mesh wound about a wick 28. Examples of suitable electrically resistive materials include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater can be formed of nickel aluminides, a material with a layer of alumina on the surface, iron aluminides and other composite materials, the electrically resistive material may optionally be embedded in, encapsulated or coated with an insulating material or vice-versa, depending on the kinetics of energy transfer and the external physicochemical properties required. Preferably, the heater 14 comprises at least one material selected from the group consisting of stainless steel, copper, copper alloys, nickel-chromium alloys, superalloys and combinations thereof. In a preferred embodiment, the heater 14 is formed of nickel-chromium alloys or iron-chromium alloys.

In another embodiment, the heater 14 may be constructed of an iron-aluminide (e.g., FeAl or $Fe_3Al$), such as those described in commonly owned U.S. Pat. No. 5,595,706 to Sikka et al. filed Dec. 29, 1994, or nickel aluminides (e.g., $Ni_3Al$). Use of iron-aluminides is particularly advantageous in that they exhibit high resistivity. FeAl exhibits a resistivity of approximately 180 micro-ohms, whereas stainless steel exhibits approximately 50 to 91 micro-ohms. The higher resistivity lowers current draw or load on the power source (battery) 1.

In a preferred embodiment, the mesh material heater 14 is formed of a thermally and/or electrically conductive material. Suitable materials for forming the mesh material are selected from the group consisting of stainless steel, copper, copper alloys, Inconel® available from Special Metals Corporation, which is a nickel-chromium alloy, Nichrome®, which is also a nickel-chromium alloy, and combinations thereof. Moreover, in a preferred embodiment, the mesh material heater 14 is formed of an iron-free nickel-chromium alloy.

In a preferred embodiment, the heater 14 comprises a ribbon of wire mesh which at least partially surrounds the wick 28. In that embodiment, preferably the heater may extend along the entire length of the wick 28 or only along a portion of the length of the wick 28.

In another embodiment, as shown in FIGS. 8-11, the heater 14 is formed of a planar metal ribbon such as a conductive mesh material wrapped around the wick 28. Preferably, the mesh material is wrapped completely around a portion of the wick 28 at least one turn, but preferably about a predetermined number of turns (e.g., two to ten turns or two to six turns). In the preferred embodiment, the mesh heater 14 is wrapped bout the wick 28 about four turns. Preferably, the mesh material is originally an elongate planar ribbon that is wrapped around the wick 28 to increase surface area contact between the heater 14 and the wick 28.

Figure 10:
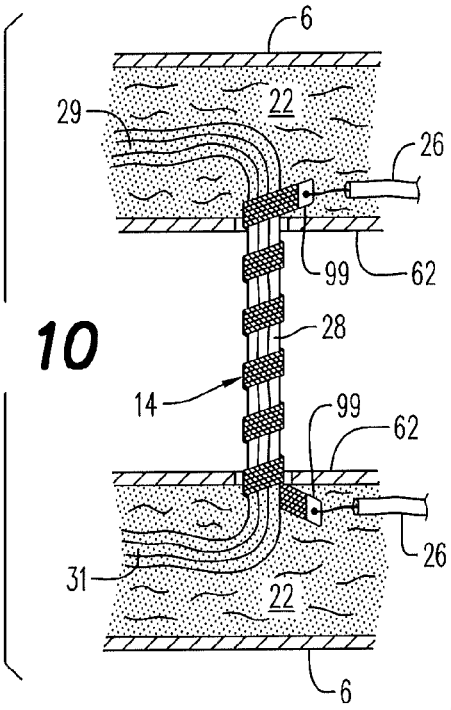
FIG. 10 is an enlarged view of an embodiment of the mesh heater and wick assembly as positioned within the electronic cigarette and including a brazed connection region.
Figure 11:
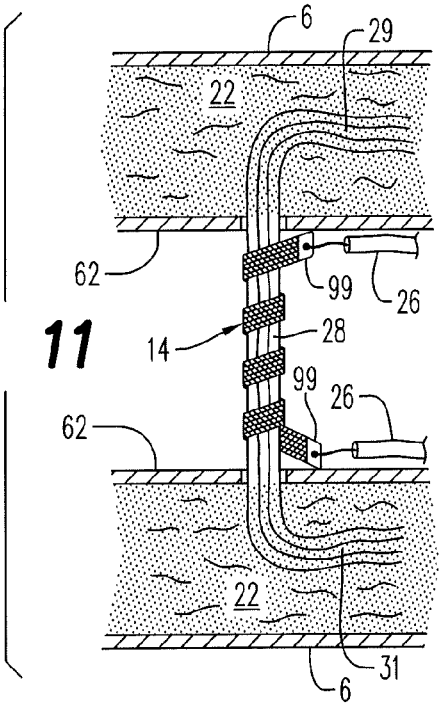
FIG. 11 is an enlarged view of another embodiment of the mesh heater and wick assembly as positioned within the electronic cigarette and including a brazed connection region.
Figure 12:
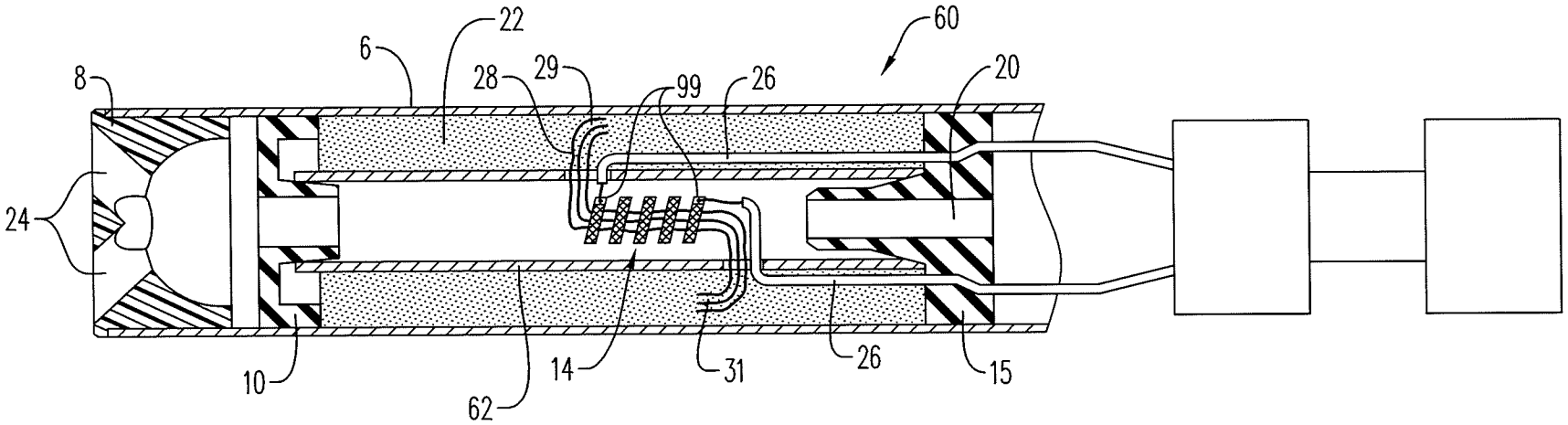
FIG. 12 is an abbreviated, cross-sectional view of an electronic cigarette including a longitudinally extending heater.

In an embodiment, as shown in FIGS. 8, 9, 10 and 11, a post or brazed, conductive connection region 99 is formed of a low-resistance material brazed across each end portion of the heater 14. By brazing a post 99 or forming a brazed connection region 99 at each end of the mesh heater 14, the electrical current conducts uniformly across the length and width of the mesh heater 14 so as to avoid hot spots. For example, the posts or brazed connection regions 99 can be formed of gold-plated wire. The posts or brazed connection regions 99 can be contained entirely in the outer annulus as shown in FIG. 10, such that the mesh heater 14 extends into the outer annulus. Alternatively, as shown in FIG. 11, the mesh heater 14 can be contained entirely within the inner tube 62 and the posts or brazed connection regions 99 can be contained within the inner tube, such that the electrical connection is formed within the inner tube 62. Electrical leads 26 are attached to each post or brazed connection regions 99, such that a heated zone is formed between the electrical leads 26 when voltage is applied by the power supply, so as to heat the liquid material in contact with the mesh material to a temperature sufficient to at least partially vaporize the liquid. Alternatively, the electrical leads 26 can be attached directly to the mesh heater 14.

A closure ring can slide over an outer surface of the inner tube so as to substantially close off a remainder of open space provided between the heater-wick element and the slot, as described in U.S. patent application Ser. No. 13/741,254 filed Jan. 14, 2013, the entire content of which is incorporated herein by reference thereto. Moreover, the mesh heater 14 preferably has a straight and uniformly spaced wrapping of the wick 28 so as to avoid hot spots.

In a preferred embodiment, the ribbon heater 14 is constructed from a wire mesh filament having a width in the range of about 0.5 mm to about 2 mm, preferably about 1 mm, and a length in the range of about 20 mm to about 40 mm. When wrapped about the wick 28, the ribbon heater 14 establishes a heater-wick element which extends in the range of about 10 mm to about 15 mm, preferably about 12 mm or less, and a width in the range of about 0.5 mm to about 2.0 mm, preferably about 1.5 mm or less. At about 1.5 mm width, the heater-wick element is preferably oriented longitudinally within the electronic cigarette whereas heater-wick elements having a smaller width may be placed in a transverse direction within the electronic cigarette.

In the preferred embodiment, the ribbon of mesh material can range in size from about 200 mesh to about 600 mesh. In the preferred embodiment, the mesh material is about 400 mesh and includes small voids/interstices 13 between the wires that form the mesh material. Preferably, the mesh material is formed with 0.001 inch or greater diameter wire, such as wire available from Smallparts, Inc. of Logansport, Ind. Also preferably, the wire comprising the mesh is a solid wire of about 0.0014 inch to about 0.0016 inch diameter.

In the preferred embodiment, the mesh material of the ribbon heater element 14 has a criss-cross, checkerboard type pattern with interstices 13 therein. Preferably, the ribbon mesh material is a single, elongate, flat layer of mesh material. Also preferably, the mesh material achieves an electrical resistance ranging from about 0.3 Ohm to about 10 Ohms, more preferably about 0.8 Ohm to about 5.0 Ohms, more preferably about 4.0 Ohms or less.

As noted above, because the mesh material heater 14 has a larger surface area, the heater 14 contacts a larger portion of the wick 28 so as to have a capacity to provide a larger amount of aerosol. In addition, the liquid can be drawn into the interstices 13 of the mesh material from the wick 28 during a power cycle of the electronic cigarette.

Advantageously, mesh material provides a workable range of resistivity for applications such as in electronic cigarettes. In addition, the use of a mesh material heater 14 allows release of aerosol through the heater itself. In addition, the mesh material heater 14 can enhance aerosolization of liquid from the wick 28.

In the preferred embodiment, the wick 28 comprises one or more filaments. As noted above, the wick 28 is at least partially surrounded by the heater 14. Moreover, in the preferred embodiment, the wick 28 extends through opposed openings in the inner tube 62 such that each end portion 29, 31 of the wick 28 is in contact with the liquid supply 22.

It has been observed that during a power cycle, aerosol is released from portions of the wick 28 disposed between windings of the ribbon heater 14 and through the ribbon heater 14 itself.

In the preferred embodiment, the wick 28 is fibrous. For example, the wick 28 may include a plurality of fibers or threads. The fibers or threads may be generally aligned in a direction perpendicular to the longitudinal direction of the electronic cigarette. In the preferred embodiment, the wick 28 comprises filaments having a capacity to draw a liquid, more preferably a bundle of glass (or ceramic) filaments and most preferably a bundle comprising a group of windings of glass filaments, preferably three of such windings, all which arrangements are capable of drawing liquid via capillary action via interstitial spacings between the filaments. Preferably, the wick 28 is flexible and includes three strands, each strand including a plurality of filaments.

In the preferred embodiment, the power supply 1 includes a battery arranged in the electronic cigarette 60 such that the anode is downstream of the cathode. A battery anode connector 4 contacts the downstream end of the battery. The heater 14 is connected to the battery by two spaced apart electrical leads 26 (shown in FIGS. 1, 4, 8, 9, 10, 11 and 12).

Preferably, the electrical contacts or connection between the heater 14 and the electrical leads 26 are highly conductive and temperature resistant while the heater 14 is highly resistive so that heat generation occurs primarily along the heater 14 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic cigarette 60 is usable by a smoker until the energy in the power supply is depleted. Alternatively, the power supply 1 may be rechargeable and include circuitry allowing the battery to be chargeable by an external charging device. In that case, preferably the circuitry, when charged, provides power for a pre-determined number of puffs, after which the circuitry must be re-connected to an external charging device.

Preferably, the electronic cigarette 60 also includes control circuitry including a puff sensor 16. The control circuitry can include an application specific integrated circuit (ASIC). The puff sensor 16 is operable to sense an air pressure drop and initiate application of voltage from the power supply 1 to the heater 14. The control circuitry can also include a heater activation light 48 operable to glow when the heater 14 is activated. Preferably, the heater activation light 48 comprises an LED and is at an upstream end of the electronic cigarette 60 so that the heater activation light 48 takes on the appearance of a burning coal during a puff. Moreover, the heater activation light 48 can be arranged to be visible to the smoker. In addition, the heater activation light 48 can be utilized for cigarette system diagnostics. The light 48 can also be configured such that the smoker can activate and/or deactivate the light 48 for privacy, such that the light 48 would not activate during smoking if desired.

Preferably, the at least one air inlet 44*a* is located adjacent the puff sensor 16, such that the puff sensor 16 senses air flow indicative of a smoker taking a puff and activates the power supply 1 and the heater activation light 48 to indicate that the heater 14 is working.

A control circuit is integrated with the puff sensor 16 and supplies power to the heater 14 responsive to the puff sensor 16, preferably with a maximum, time-period limiter.

Alternatively, the control circuitry may include a manually operable switch for a smoker to initiate a puff. The time-period of the electric current supply to the heater may be pre-set depending on the amount of liquid desired to be vaporized. The control circuitry is preferably programmable for this purpose. Alternatively, the circuitry may supply power to the heater as long as the puff sensor detects a pressure drop.

Preferably, when activated, the heater 14 heats a portion of the wick 28 surrounded by the heater for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

In the preferred embodiment, the liquid supply 22 includes a liquid storage medium 210 containing liquid material. Alternatively, the liquid supply 22 comprises only liquid material. The liquid supply 22 is contained in an outer annulus between inner tube 62 and outer tube 6 and between stopper 10 and the seal 15. Thus, the liquid supply 22 at least partially surrounds the central air passage 20 and heater 14 and the heater 14 extends between portions of the liquid supply 22.

Preferably, the liquid storage medium 210 of the liquid supply 22, if included, is a fibrous material comprising cotton, polyethylene, polyester, rayon and combinations thereof. The liquid storage medium 210 may comprise a winding of cotton gauze or other fibrous material about the inner tube 62. Preferably, the fibers or filaments in the liquid storage medium 210 have a diameter ranging in size from about 6 microns to about 15 microns (e.g., about 8 microns to about 12 microns or about 9 microns to about 11 microns). The liquid storage medium 210 can be a sintered, porous or foamed material. Also preferably, the filaments are sized to be irrespirable and can have a cross-section which has a y shape, cross shape, clover shape or any other suitable shape. In the alternative, the liquid supply region 22 may comprise a filled tank lacking a liquid storage medium 210 and containing only liquid material. In one embodiment, the liquid storage medium 210 can be constructed from an alumina ceramic.

Also preferably, the liquid material has a boiling point suitable for use in the electronic cigarette 60. If the boiling point is too high, the heater 14 will not be able to vaporize liquid in the wick 28. However, if the boiling point is too low, the liquid may vaporize without the heater 14 being activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or be nicotine-free. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply 22 and/or liquid storage medium 21 in proximity of the 14 heater by capillary action of the wick 28. In one embodiment, the wick 28 has a first end 29 and a second end 31 as shown in FIG. 1. The first end 29 and the second end 31 extend into opposite sides of the liquid storage medium 21 for contact with liquid material contained therein. Also preferably, the heater 14 at least partially surrounds a central portion of the wick 28 such that when the heater is activated, the liquid in the central portion of the wick 28 is vaporized by the heater 14 to vaporize the liquid material and form an aerosol.

One advantage of this embodiment is that the liquid material in the liquid supply 22 is protected from oxygen (because oxygen cannot generally enter the liquid storage portion via the wick) and, in some embodiments light, so that the risk of degradation of the liquid material is significantly reduced. Thus, a high level of shelf-life and cleanliness can be maintained.

Figure 2:
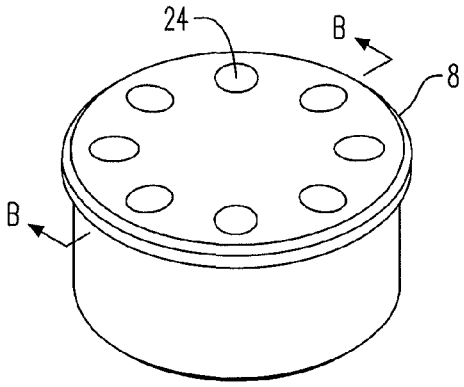
FIG. 2 is a perspective view of a mouth-end insert for use with the electronic cigarette of FIG. 1.
Figure 3:
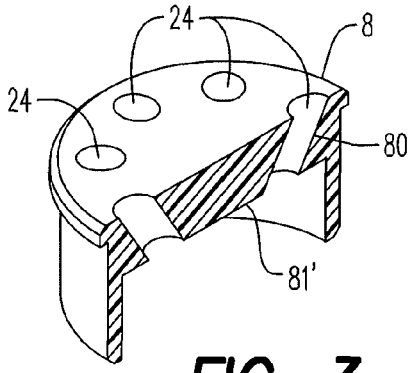
FIG. 3 is a cross-sectional view along line B-B of the mouth-end insert of FIG. 2.

As shown in FIGS. 1-3, the mouth-end insert 8, includes at least two diverging outlets 24. (e.g, 3, 4, 5, or preferably 6 to 8 outlets or more). Preferably, the outlets 24 of the mouth-end insert 8 are located at ends of off-axis passages 80 (shown in FIG. 3) and are angled outwardly in relation to the longitudinal direction of the electronic cigarette 60 (i.e., divergently). As used herein, the term "off-axis" denotes at an angle to the longitudinal direction of the electronic cigarette. Also preferably, the mouth-end insert (or flow guide) 8 includes outlets uniformly distributed around the mouth-end insert 8 so as to substantially uniformly distribute aerosol in a smoker's mouth during use. Thus, as the aerosol passes into a smoker's mouth, the aerosol enters the mouth and moves in different directions so as to provide a full mouth feel as compared to electronic cigarettes having an on-axis single orifice which directs the aerosol to a single location in a smoker's mouth.

In addition, the outlets 24 and off-axis passages 80 are arranged such that droplets of unaerosolized liquid material carried in the aerosol impact interior surfaces 81 of the mouth-end insert 8 and/or interior surfaces of the off-axis passages such that the droplets are removed or broken apart. In the preferred embodiment, the outlets of the mouth-end insert are located at the ends of the off-axis passages and are angled at 5 to 60° with respect to the central axis of the outer tube 6 so as to more completely distribute aerosol throughout a mouth of a smoker during use and to remove droplets.

Preferably, each outlet has a diameter of about 0.015 inch to about 0.090 inch (e.g., about 0.020 inch to about 0.040 inch or about 0.028 inch to about 0.038 inch). In one embodiment, the size of the outlets 8 and off-axis passages 80 along with the number of outlets can be selected to adjust the resistance to draw (RTD) of the electronic cigarette 60, if desired.

As shown in FIG. 1, an interior surface 81 of the mouth-end insert 8 can comprise a generally domed surface. Alternatively, as shown in FIG. 3, the interior surface 81' of the mouth-end insert 8 can be generally cylindrical or frustoconical, with a planar end surface. Preferably, the interior surface is substantially uniform over the surface thereof or symmetrical about the longitudinal axis of the mouth-end insert 8. However, in other embodiments, the interior surface can be irregular and/or have other shapes.

Preferably, the mouth-end insert 8 is integrally affixed within the outer tube 6 of the first section 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In a preferred embodiment, the electronic cigarette 60 is about the same size as a conventional cigarette. In some embodiments, the electronic cigarette 60 can be about 80 mm to about 110 mm long, preferably about 80 mm to about 100 mm long and about 7 mm to about 8 mm in diameter. For example, in a preferred embodiment, the electronic cigarette is about 84 mm long and has a diameter of about 7.8 mm.

In one embodiment, the electronic cigarette 60 can also include a filter segment (not shown) upstream of the heater 14 and operable to restrict flow of air through the electronic cigarette 60. The addition of a filter segment can also aid in adjusting the resistance to draw.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle.

As shown in FIG. 4, the electronic cigarette 60 can also include a sleeve assembly 87 removably and/or rotatably positioned about a first section 70 of the electronic cigarette 60. Moreover, the sleeve assembly 87 insulates at least a portion of the first section 70 so as to maintain the temperature of the aerosol prior to delivery to the smoker. In the preferred embodiment, the sleeve assembly 87 is rotatable about the electronic cigarette 60 and includes spaced apart slots 88 arranged transversely about the sleeve assembly such that the slots 88 line up with the air inlets 44 in the first section 70 to allow air to pass into the electronic cigarette 60 when a smoker draws a puff. Before or during smoking, the smoker can rotate the sleeve assembly 87 such that the air inlets 44 are at least partially blocked by the sleeve assembly 87 so as to adjust the resistance to draw and/or ventilation of the electronic cigarette 60.

Preferably, the sleeve assembly 87 is made of silicone or other pliable material so as to provide a soft mouthfeel to the smoker. Moreover, the sleeve assembly 81 can prevent the outer tube 6 from warming a smoker's mouth if too much heat is generated. However, the sleeve assembly 87 can be formed in one or more pieces and can be formed of a variety of materials including plastics, metals and combinations thereof. In a preferred embodiment, the sleeve assembly 87 is a single piece formed of silicone. The sleeve assembly 87 can be removed and reused with other electronic cigarettes or can be discarded along with the first section 70. The sleeve assembly 87 can be any suitable color and/or can include graphics or other indicia.

As shown in FIG. 5, the electronic cigarette 60 can also include an aroma strip 89 located on an outer surface 91 of at least one of the first section 70 and the second section 72. Alternatively, the aroma strip 89 can be located on a portion of the sleeve assembly 87. Preferably, the aroma strip 89 is located between the battery of the device and the heater such that the aroma strip 89 is adjacent a smoker's nose during smoking. The aroma strip 89 can include a flavor aroma gel, film or solution including a fragrance material that is released before and/or during smoking. In one embodiment, the flavor aroma of the gel, fluid and/or solution can be released by the action of a puff which may open a vent over the aroma strip when positioned inside the first section 70 (not shown). Alternatively, heat generated by the heater 14 can cause the release of the aroma.

In one embodiment, the aroma strip 89 can include tobacco flavor extracts. Such an extract can be obtained by grinding tobacco material to small pieces and extracting with an organic solvent for a few hours by shaking the mixture. The extract can then be filtered, dried (for example with sodium sulfate) and concentrated at controlled temperature and pressure. Alternatively, the extracts can be obtained using techniques known in the field of flavor chemistry, such as the Solvent Assisted Flavor Extraction (SAFE) distillation technique (Engel et al. 1999), which allows separation of the volatile fraction from the non-volatile fraction. Additionally, pH fractionation and chromatographic methods can be used for further separation and/or isolation of specific compounds. The intensity of the extract can be adjusted by diluting with an organic solvent or water.

The aroma strip 89 can be a polymeric or paper strip to which the extract can be applied, for example, using a paintbrush or by impregnation. Alternatively, the extract can be encapsulated in a paper ring and/or strip and released manually by the smoker, for example by squeezing the aroma strip 89 during smoking so as to release the aroma.

Figure 6:
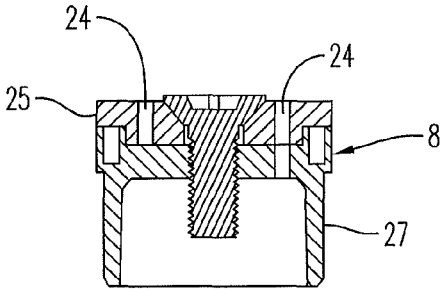
FIG. 6 is a cross-sectional view of a second embodiment of a mouth-end insert for use with the electronic cigarettes of FIGS. 1 and 4.
Figure 7:
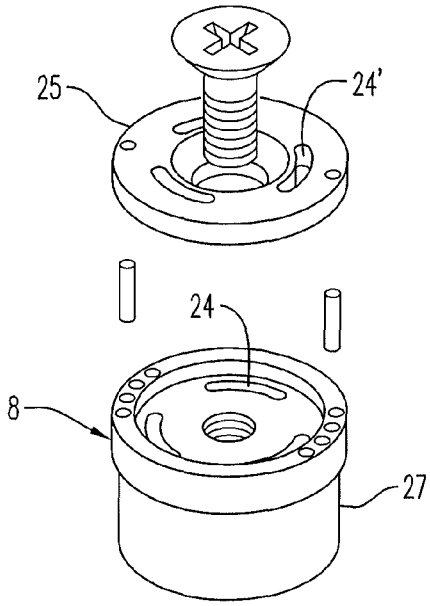
FIG. 7 is an exploded view of the mouth-end insert of FIG. 6.
Figure 8:
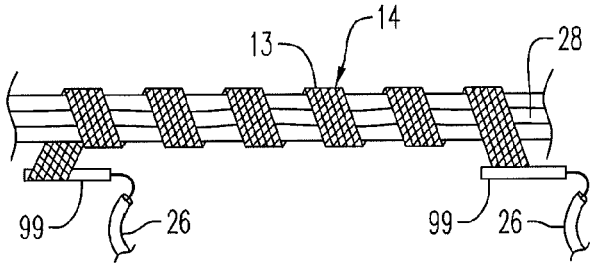
FIG. 8 is an enlarged view of a heater for use in the electronic cigarette of FIGS. 1 and 4, wherein the heater is formed of a mesh material.
Figure 9:
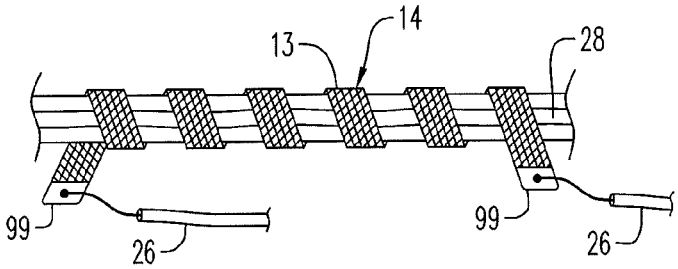
FIG. 9 is an enlarged view of a heater, wherein the heater includes a brazed connection region.

As shown in FIGS. 6 and 7, in an alternative embodiment, the electronic cigarette of FIGS. 1, 4, 9 and 12 can includes a mouth-end insert 8 having a stationary piece 27 and a rotatable piece 25. Outlets 24, 24' are located in each of the stationary piece 27 and the rotatable piece 25. The outlets 24, 24' match up as shown to allow aerosol to enter a smoker's mouth. However, the rotatable piece 25 can be rotated within the mouth-end insert 8 so as to at least partially block one or more of the outlets 24 in the stationary piece 27 of the mouth-end insert 8. Thus, the consumer can adjust the amount of aerosol drawn with each puff. The outlets 24, 24' can be formed in the mouth-end insert 8 such that the outlets 24, 24' diverge to provide a fuller mouth feel during inhalation of the aerosol.

The above teachings provide examples of an electronic cigarette 60. Further details of the electronic cigarette can be found in commonly owned Non-Provisional patent application Ser. No. 13/756,127 filed Jan. 31, 2013, the entire content of which is incorporated herein by reference thereto.

Not wishing to be bound by theory, it is believed that the amount of voltage applied to the mesh heater can alter the particle size distribution of the aerosol.

The teachings herein are applicable to electronic cigars, and other smoking articles. References to an "electronic smoking article" are intended to be inclusive of electronic cigars, electronic cigarettes and the like.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and nonobvious electronic cigarette has been described in this specification with sufficient particularity as to be understood by one of ordinary skill in the art. Moreover, it will be apparent to those skilled in the art that numerous modifications, variations, substitutions, and equivalents exist for features of the electronic cigarette which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic cigarette comprising:

a heater, the heater comprising a ribbon of electrically resistive mesh material wound about a filamentary wick, said wick in communication with a liquid supply including liquid material, the heater being configured to vaporize liquid material, wherein the ribbon is wrapped about the wick so that there is spacing between windings of the ribbon heater about the wick.

2. The electronic cigarette of claim 1, wherein the electrically resistive mesh material comprises at least one material selected from the group consisting of stainless steel, copper, copper alloys, ceramic materials coated with film resistive material, nickel-chromium alloys, and combinations thereof and the conductive mesh has a tubular shape and is in contact with the wick.

3. The electronic cigarette of claim 1, wherein the electrically resistive mesh material is about 200 to about 600 mesh.

4. The electronic cigarette of claim 1, wherein the electrically resistive mesh material is about 400 mesh.

5. The electronic cigarette of claim 1, wherein the electrically resistive mesh material is formed with wire having a diameter of greater than about 0.001 inch.

6. The electronic cigarette of claim 1, wherein the electrically resistive mesh material is wound about the wick about 1 to about 10 times.

7. The electronic cigarette of claim 1, wherein the mesh material is elongate and planar at at least one end portion thereof.

8. The electronic cigarette of claim 1, wherein the heater has a length ranging from about 10 mm to about 15 mm and a width ranging from about 0.5 mm to about 2.0 mm.

9. An electronic smoking article comprising:

a heater, the heater comprising a ribbon of electrically resistive mesh material wound about a filamentary wick, said wick in communication with a liquid supply including liquid material, the heater being configured to vaporize liquid material to produce a vapor wherein the ribbon is wrapped about the wick so that there is spacing between windings of the ribbon heater about the wick.

10. The electronic smoking article of claim 9, wherein the electrically resistive mesh material comprises at least one material selected from the group consisting of stainless steel, copper, copper alloys, ceramic materials coated with film resistive material, nickel-chromium alloys, and combinations thereof and the conductive mesh has a tubular shape and is in contact with the wick.

11. The electronic smoking article of claim 9, wherein the electrically resistive mesh material is about 200 to about 600 mesh.

12. The electronic smoking article of claim 9, wherein the electrically resistive mesh material is about 400 mesh.

13. The electronic smoking article of claim 9, wherein the electrically resistive mesh material is formed with wire having a diameter of greater than about 0.001 inch.

14. The electronic smoking article of claim 9, wherein the electrically resistive mesh material is wound about the wick about 1 to about 10 times.

15. The electronic smoking article of claim 9, wherein the mesh material is elongate and planar at at least one end portion thereof.

16. The electronic smoking article of claim 9, wherein the heater has a length ranging from about 10 mm to about 15 mm and a width ranging from about 0.5 mm to about 2.0 mm.

17. The electronic smoking article of claim 9, wherein the mesh material has an electrical resistance ranging from about 0.3 Ohm to about 10 Ohms.

18. The electronic smoking article of claim 9, wherein the ribbon of electrically resistive mesh material includes a conductive connection region across a width of the ribbon.

* * * * *